313-422 SR

2/15/83 OR 4,374,343

United States Patent [19]

Chang

[11] 4,374,343

[45] Feb. 15, 1983

[54] THIN KINESCOPE AND ELECTRON BEAM REFLECTOR THEREFOR

[75] Inventor: Kern K. N. Chang, Princeton, N.J.

[73] Assignee: RCA Corporation, New York, N.Y.

[21] Appl. No.: 180,899

[22] Filed: Aug. 25, 1980

[51] Int. Cl.[3] ..... H01J 29/72; H01J 31/08

[52] U.S. Cl. ..... 313/422; 313/434

[58] Field of Search ..... 313/423, 422, 433, 434

[56] References Cited

U.S. PATENT DOCUMENTS

| | | | |
|---|---|---|---|
| 2,999,957 | 9/1961 | Schagen et al. | 313/422 |
| 3,064,154 | 11/1962 | Law | 313/422 |
| 3,205,391 | 9/1965 | Glyptis | 313/422 |
| 3,299,314 | 1/1967 | Yamada et al. | 313/422 |
| 4,137,479 | 1/1979 | Janko | 313/434 X |
| 4,180,760 | 12/1979 | Chang | 313/422 |

FOREIGN PATENT DOCUMENTS

| | | |
|---|---|---|
| 801841 | 9/1958 | United Kingdom . |
| 825876 | 12/1959 | United Kingdom . |
| 1354681 | 5/1974 | United Kingdom . |
| 1354682 | 5/1974 | United Kingdom . |

*Primary Examiner*—Robert Segal

*Attorney, Agent, or Firm*—Eugene M. Whitacre; Dennis H. Irlbeck; Lester L. Hallacher

[57] ABSTRACT

A thin kinescope has the electron gun positioned to emit electrons so that the initial direction of travel is substantially parallel to the plane of the screen. A bowl-shaped reflector is positioned to bend the electron beams toward the screen and to improve the focusing of the electron beams. A unique combination of deflection enhancement and a shunted quadrupole result in maximum deflection so that the entire screen is scanned by the electron beams.

4 Claims, 4 Drawing Figures

THIN KINESCOPE AND ELECTRON BEAM REFLECTOR THEREFOR

BACKGROUND OF THE INVENTION

This invention relates generally to kinescopes in which the undeflected electron beam travel is substantially parallel to the screen and particularly to such a kinescope having an electron beam focusing reflector and deflection enhancement means to assure complete scanning of the screen.

Efforts to decrease the overall length of kinescopes have resulted in various attempts to construct kinescopes in which the undeflected electron beams travel substantially parallel to the plane of the faceplate. Such efforts have not been successful because of the difficulties encountered in effectively deflecting the electron beams to scan the entire phosphor screen while simultaneously focusing the electron beams and bending them toward the screen. Example of the prior art efforts are found in U.S. Pat. No. 3,064,154, to H. B. Law and U.S. Pat. No. 2,999,957 to P. Schagen et al.

The instant invention is directed to a kinescope which overcomes these difficulties.

SUMMARY OF THE INVENTION

A thin kinescope includes a faceplate, a backplate and a screen on the inside surface of the faceplate. An electron gun is arranged to provide electrons which, when undeflected, travel generally parallel to the plane of the screen. A bowl-shape reflector is positioned between and spaced from the screen and the backplate. The reflector is oriented with the concave surface facing the screen to focus and reflect the electrons toward the screen. A quadrupole having a shunted divergent action increases the horizontal beam deflection. A deflection enhancement lens enhances both the horizontal and vertical beam deflections.

DETAILED DESCRIPTION OF THE PREFERRED EMBODIMENT

Figure 1:
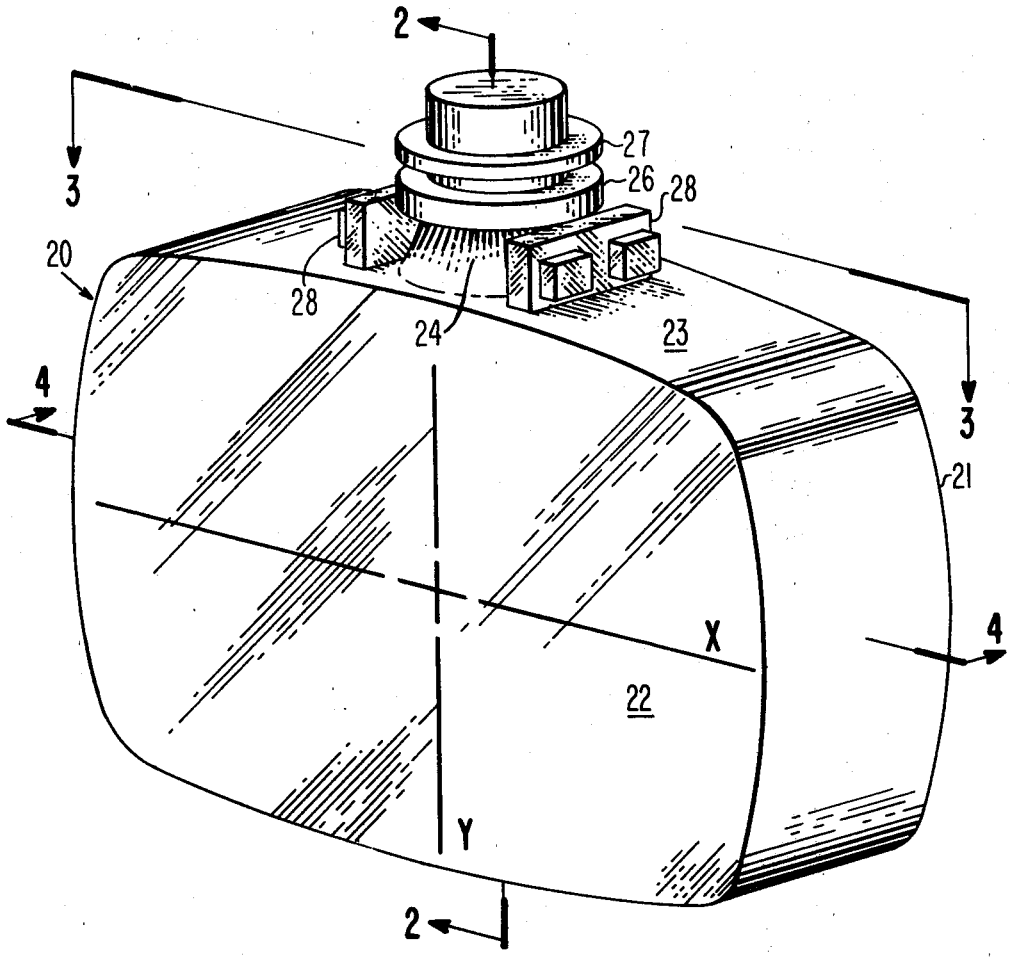
FIG. 1 is a perspective of a preferred embodiment.
Figure 2:
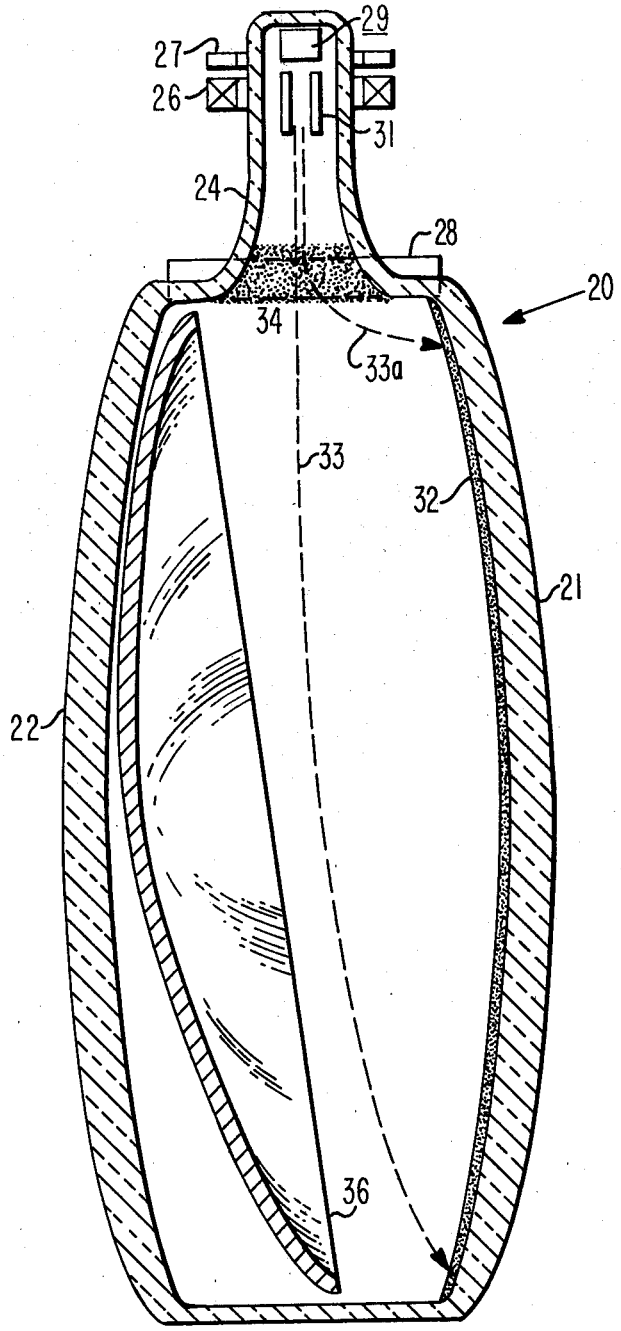
FIG. 2 is a cross-section taken along line 2—2 of FIG. 1.

FIGS. 1 and 2 show a thin kinescope 20 having a faceplate 21 and a backplate 22 held in a spaced relationship by sidewalls 23. A neck 24 is centered in one of the sidewalls 23 and houses an electron gun 29 which emits electrons into the envelope in a direction such that the initial travel of the electron beams is substantially parallel to the plane of a phosphor screen 32 which is affixed to the inside surface of the faceplate 21. The screen 32 produces a visual display across the faceplate 21 when struck by electrons from the gun 29.

A yoke 26, of a type well known in the art, is coaxially centered about the neck 24 and serves to cause the electron beams to horizontally and vertically scan across the faceplate 21 when energized with appropriate horizontal and vertical defection voltages. As shown in FIG. 1, horizontal and vertical scanning across the faceplate 21 respectfully occur in the X axis and Y axis directions.

Also, positioned about the neck 24 is a keystone correction magnet 27. As is known to those skilled in the art, the keystone effect in kinescopes is the failure of the electron beam to scan the corners of the screen. Thus, for the orientation shown in FIG. 1 in the absence of keystone correction, the upper right and left hand corners of the screen 21 would not be scanned with electron beams. The correction coil 27, thus, is a small separately wound magnet which is swept at the vertical scanning rate to add additional horizontal deflection to the electron beams so that the corners are scanned by the beam.

A quadrupole 28, having a shunted internal divergent action, is arranged on both sides of the neck 24 to enhance the electron beam horizontal deflection. This device and the operation thereof are described in application Ser. No. 154,602, filed May 29, 1980 by Kern Ko Nan Chang and entitled "Horizontal Deflection Enhancement For Kinescopes" now U.S. Pat. No. 4,329,618.

Figure 3:
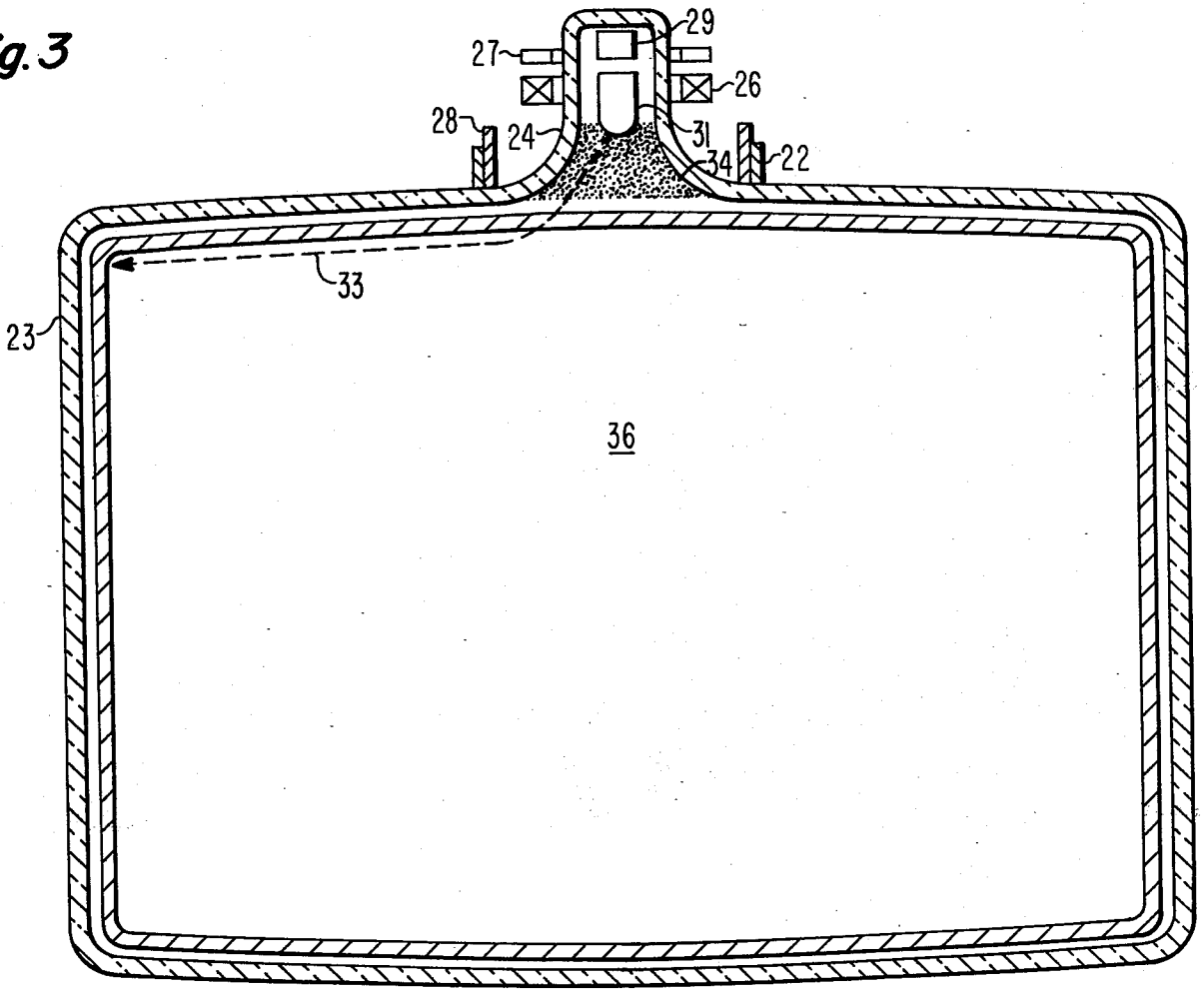
FIG. 3 is a cross-section taken along line 3—3 of FIG. 1.

As shown in FIGS. 2 and 3, the electron gun 29 and a deflection enhancement device 31 of the type described in application Ser. No. 154,835, filed May 30, 1980 by Kern Ko Nan Chang and entitled "System For Enhancing Deflection In Kinescopes" now U.S. Pat. No. 4,323,816 are centered in the neck 24 of the kinescope 20. The electron gun 29 is arranged in the neck 24 so that undeflected electron beams emanating from the electron gun travel in a path which is substantially parallel to the phosphor screen 32. The deflection enhancement device 31 operates to increase the horizontal and vertical deflections which cause the electron beam to scan the screen 32 and also serves to bend the electron beam 90° toward the screen 32. When the upper portion of the screen 32 is scanned the electrons follow the path 33*a* of FIG. 2, and as the horizontal and vertical deflection voltages are changed, the entire screen is scanned. The inside of the throat portion of the neck 24 is coated with a conductive material to form an electrode 34 which is biased at a high positive potential, such as 5 kilovolts, to achieve post deflection acceleration of the electron beams.

Figure 4:
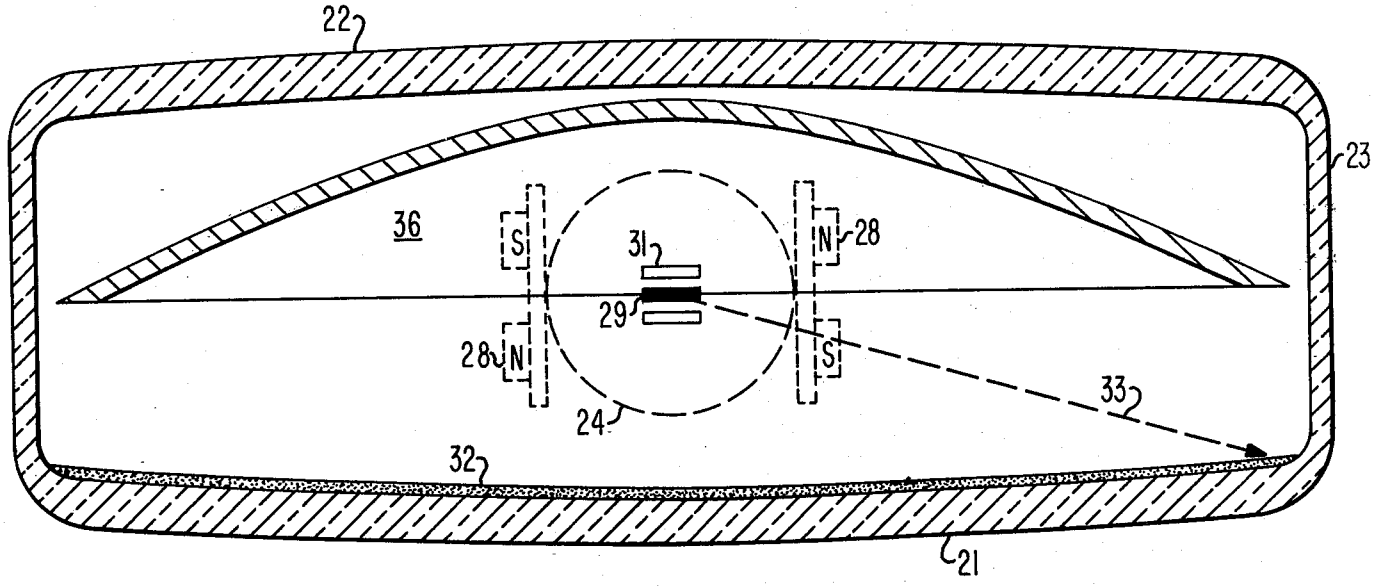
FIG. 4 is a cross-section taken along line 4—4 of FIG. 1.

As shown in FIGS. 2 and 4 a bowl-shaped reflector 36 is angularly displaced with respect to the vertical, or Y axis, so that the edge of the reflector closest to the electron gun 29 is further displaced from the center line of the tube than the edge of the reflector which is furthest away from the electron gun 29. The reflector 36 is symmetrically disposed with respect to the horizontal, or X, axis. The screen 32 of the kinescope is generally rectangular and accordingly the reflector 36 is generally rectangular. The nature of the curvature of the reflector 36 is dependent upon the required horizontal deflection angle needed to cause the electron beam 33 to completely scan the screen 32. As the horizontal dimension of the screen increases the required horizontal scan angle also increases. Accordingly, when total horizontal deflection angles such as 90° to 100° are needed, the curvature of the reflector 36 would be a quadratic function, such as a circle or elipse. Preferably, the nature of the curvature would be the same in both the X and Y planes even though the rectangular configuration of the reflector would require dimensional differences with respect to the two axis. When larger deflection angles in excess of 100° are required, the curvature would be expotential. For example, a tube having a 25 inch (63.5 cm) diagonal requires a larger deflection angle and preferably would include a reflector 36 having an expotentially defined curvature while a smaller tube, such as a 19 inch (48.26 cm) diagonal could include a reflector having a quadratically defined curvature. Tubes which require less than 90° horizontal deflection could possibly use a linearly defined, that is flat, reflector. Such a reflector could be considered to be a circular bowl having an infinite radius of curvature.

In operation the post deflection acceleration electrode 34 is set at a positive potential such as 5 kilovolts. Electrons emanating from the deflection enhancement device 31 are thus increased in velocity after passing through the last of the three deflection devices, 26, 31 and 28.

The screen 32 is set at a high potential, such as 25 kilovolts, and the reflector 36 is set at a lower potential, such as 20 kilovolts so that electrons are reflected toward the screen 32 by the combined actions of the reflector 36 and the enhancement device 31. The operation of the enhancement device 31 is fully described in U.S. Pat. No. 4,323,816. The enhancement device 31 also horizontally and vertically deflects the electron beams and the quadrupole 28 further increases the horizontal deflection in the manner described in U.S. Pat. No. 4,329,618. These deflections combined with the horizontal and vertical deflections created by the yoke 26 and the keystone correction winding 27 cause the electron beams 33 to horizontally and vertically scan the entire surface of the phosphor screen 32. Because the reflector 36 is tilted along the Y-axis with respect to the center line of the kinescope 20, the electrostatic field established between the reflector 36 and the phosphor screen 32 gradually increases as the distance along the Y-axis from the gun 29 increases. Also, because of the curvature of the reflector 36, the electrons get closer to the reflector as the distance from the gun 29 increases. Thus, as the electron beams get nearer to the reflector, the vector component of the reflector repelling force which acts directly opposite to the direction of electron travel increases and the electrons are slowed. The slowing subjects the electrons to a particular electrostatic field for a longer time tending to focus the electrons. Accordingly, the reflector 36 horizontally and vertically focuses the electron beams and the focusing increases as the extremities of the reflector are approached because the electron beams move closer to the reflector 36 as the horizontal and vertical distances from the gun increase.

As shown in FIGS. 2, 3 and 4 the combined actions of the yoke 26, the deflection enhancement device 31 and the quadrupole 28 deflect the electron beam 33 to scan the upper regions of the screen 32. With a particular vertical deflection voltage applied to the yoke 26, the electron beam 33 impacts the screen 32 at a vertical position which is determined by the magnitude of the vertical voltage. The application of a saw tooth waveform to the horizontal deflection coil within the yoke 26 causes the electron beam to horizontally scan one complete line across the face of the screen at that same vertical position. The combined actions of the deflection enhancement device 31, and the reflector 36, simultaneously cause the electron beams to bend the required 90° to impact the screen. After the changes in the horizontal deflection voltage have moved the beam across the full horizontal dimension of the screen one complete horizontal line has been scanned and a slight change in the vertical deflection voltage causes the electron beam to strike the screen at a different vertical position and a horizontal line slightly lower than the originally scanned line will be scanned. This scanning action continues until the entire screen is scanned.

FIG. 4 shows that the reflector 36 extends across the entire horizontal dimension of the kinescope 20 and is symmetrical with respect to the center of the kinescope. For the orientation shown in FIG. 4, the electron beams travel is upwardly out of the plane of the paper. The beams 33 are bent at 90° to strike the screen 32, while being horizontally and vertically deflected to scan the entire screen. FIG. 4 also shows that the electrons travel closer to the reflector 36 as the horizontal distance from the gun 29 increases.

What is claimed is:

1. A thin kinescope comprising:

a faceplate, a backplate, a screen on the inside surface of said faceplate, an electron gun for providing electrons, and a neck for housing said electron gun arranged so that an undeflected electron beam from said gun initially travels generally parallel to the plane of said screen, a yoke for horizontally and vertically deflecting said electron beam to scan said screen, a bowl-shaped reflector for focusing said electron beam positioned between and spaced from said faceplate and said backplate and oriented with the concave side facing said faceplate so that electrons from said gun travel along said faceplate between said reflector and said faceplate and are reflected toward said screen by said reflector, said reflector being tilted with respect to said faceplate so that the displacement between said reflector and said faceplate decreases in the direction of electron travel;

a quadrupole having a shunted divergent action for increasing said horizontal deflection and;

a deflection enhancement lens for enhancing said horizontal and vertical deflection.

2. The kinescope of claim 1 wherein said kinescope is rectangular and said neck is centered in one side.

3. The kinescope of claim 1 wherein the curvature of said bowl-shaped reflector is quadratic.

4. The kinescope of claim 1 wherein the curvature of said bowl-shaped reflector is exponential.

* * * * *